US006907868B2

(12) United States Patent
Veinotte

(10) Patent No.: US 6,907,868 B2
(45) Date of Patent: Jun. 21, 2005

(54) MODULAR EXHAUST GAS RECIRCULATION ASSEMBLY

(75) Inventor: Andre Veinotte, Dresden (CA)

(73) Assignee: Siemens VDO Automotive, Inc., Chatham (CA)

( * ) Notice: Subject to any disclaimer, the term of this patent is extended or adjusted under 35 U.S.C. 154(b) by 14 days.

(21) Appl. No.: 10/387,416

(22) Filed: Mar. 14, 2003

(65) Prior Publication Data

US 2004/0177839 A1 Sep. 16, 2004

(51) Int. Cl.[7] ..... F02M 25/07

(52) U.S. Cl. ..... 123/568.18; 123/568.24

(58) Field of Search ..... 123/568.11, 568.17, 123/568.18, 568.19, 568.2, 568.21, 568.23, 568.24, 337, 399, 184.21, 184.61; 251/129.11, 129.12

(56) References Cited

U.S. PATENT DOCUMENTS

| | | | | |
|---|---|---|---|---|
| 3,741,179 | A | 6/1973 | Vartanian | 123/568.18 |
| 3,915,134 | A | 10/1975 | Young et al. | |
| 4,094,285 | A | 6/1978 | Oyama et al. | 123/568.18 |
| 4,171,689 | A | 10/1979 | Eheim | 123/568.18 |
| 4,196,708 | A | 4/1980 | May et al. | 123/568.18 |
| 4,214,562 | A | 7/1980 | Mowbray | 123/568.18 |
| 4,222,356 | A | 9/1980 | Ueda et al. | 123/568.18 |
| 4,230,080 | A | 10/1980 | Stumpp et al. | 123/568.18 |

(Continued)

FOREIGN PATENT DOCUMENTS

| | | |
|---|---|---|
| EP | 0 840 000 | 5/1998 |
| JP | 11 294267 | 10/1999 |
| JP | 2000-45879 | 2/2000 |

OTHER PUBLICATIONS

U.S. Appl. No. 10/387,439, filed Mar. 14, 2003, Veinotte, Electric Actuator Assembly and Method for Controlling an Exhaust Gas Recirculation Assembly.
U.S. Appl. No. 10/465,867, filed Jun. 20, 2003, Veinotte et al., Purge Control Device for Low Vacuum Condition.
U.S. Appl. No. 10/387,439, filed Mar. 14, 2003, Veinotte, Electric Actuator Assembly and Method for Controlling an Exhaust Gas Recirculation Assembly.
U.S. Appl. No. 10/164,559, filed Jun. 10, 2002, Veinotte, Exhaust Gas Recirculation System.
U.S. Appl. No. 10/290,441, filed Nov. 8, 2002, Veinotte, Modular Exhaust Gas Recirculation Assembly.

*Primary Examiner*—Willis R. Wolfe, Jr.

(57) ABSTRACT

A modular exhaust gas recirculation assembly includes a flow control body, a closing member movably mounted in the manifold conduit between a first position and a second position, and an actuator assembly coupled to the closing member and driving the closing member between the first position and the second position. The flow control body includes a manifold conduit and an inlet conduit in fluid communication with the manifold conduit. The manifold conduit includes manifold conduit a recirculation opening, a first open end having a first cross-sectional shape, and a second open end having a second cross-sectional shape. The closing member includes a boundary defining an operative surface. The boundary has a configuration that is different from the first cross-sectional shape and the second cross-sectional shape. When in the first position, the closing member closes the recirculation opening and blocks fluid communication between the inlet conduit and the manifold conduit. When in the second position, the closing member opens the recirculation opening and permits fluid communication between the inlet conduit and the manifold conduit such that the operative surface creates a pressure differential across the recirculation opening so that fluid is drawn from the inlet conduit into the manifold conduit.

23 Claims, 7 Drawing Sheets

U.S. PATENT DOCUMENTS

| | | | | | |
|---|---|---|---|---|---|
| 4,237,837 | A | | 12/1980 | Toda et al. | 123/568.18 |
| 4,279,235 | A | | 7/1981 | Flaig et al. | 123/568.18 |
| 4,279,473 | A | | 7/1981 | Yamana | |
| 4,280,470 | A | | 7/1981 | Ueda | 123/568.18 |
| 4,286,567 | A | | 9/1981 | Ueda | 123/568.18 |
| 4,295,456 | A | | 10/1981 | Nomura et al. | 123/568.18 |
| 4,329,965 | A | * | 5/1982 | Ueda et al. | 123/568.18 |
| 4,364,369 | A | | 12/1982 | Nomura et al. | 123/568.18 |
| 4,690,119 | A | | 9/1987 | Makino et al. | |
| 5,305,720 | A | * | 4/1994 | Ando et al. | 123/568.24 |
| 5,333,456 | A | | 8/1994 | Bollinger | 60/605.2 |
| 5,542,711 | A | * | 8/1996 | Vaudry | 123/568.17 |
| 5,596,966 | A | * | 1/1997 | Elder | 123/337 |
| 5,785,034 | A | * | 7/1998 | Moedinger et al. | 123/568.18 |
| 5,937,834 | A | | 8/1999 | Oto | 123/568.18 |
| 5,937,835 | A | | 8/1999 | Turner et al. | |
| 6,102,016 | A | | 8/2000 | Sitar et al. | |
| 6,135,415 | A | * | 10/2000 | Kloda et al. | 123/568.18 |
| 6,382,195 | B1 | | 5/2002 | Green et al. | |
| 6,435,169 | B1 | | 8/2002 | Vogt | |
| 6,494,041 | B1 | * | 12/2002 | Lebold | 123/568.18 |
| 2002/0185116 | A1 | | 12/2002 | Veinotte | |
| 2003/0085887 | A1 | | 5/2003 | Veinotte | |
| 2003/0111066 | A1 | | 6/2003 | Veinotte | |
| 2003/0116146 | A1 | | 6/2003 | Fensom et al. | |

* cited by examiner

MODULAR EXHAUST GAS RECIRCULATION ASSEMBLY

BACKGROUND OF THE INVENTION

One conventional exhaust gas recirculation (EGR) system for compression ignition internal combustion engines uses two actuators. The first actuator creates a pressure differential in the intake conduit that draws exhaust gas from the exhaust conduit into the intake conduit where it mixes with the intake charge. The second actuator regulates the flow rate of exhaust gas in the exhaust conduit that is drawn into the intake conduit by the first actuator.

Another conventional EGR system employs a single actuator to regulate the flow rate of exhaust gas drawn into the intake conduit from the exhaust conduit. A stationary throttling device is located in the exhaust conduit to promote the flow of exhaust gas into the intake conduit. The negative pressure pre-existing in the intake conduit created during the intake stroke of the engine provides the pressure differential needed to draw the exhaust gas into the intake conduit.

SUMMARY OF THE INVENTION

There is provided a modular exhaust gas recirculation assembly includes a flow control body, a closing member movably mounted in the manifold conduit between a first position and a second position, and an actuator assembly coupled to the closing member and driving the closing member between the first position and the second position. The flow control body includes a manifold conduit and an inlet conduit in fluid communication with the manifold conduit. The manifold conduit includes manifold conduit a recirculation opening, a first open end having a first cross-sectional shape, and a second open end having a second cross-sectional shape. The closing member includes a boundary defining an operative surface. The boundary has a configuration that is different from the first cross-sectional shape and the second cross-sectional shape. When in the first position, the closing member closes the recirculation opening and blocks fluid communication between the inlet conduit and the manifold conduit. When in the second position, the closing member opens the recirculation opening and permits fluid communication between the inlet conduit and the manifold conduit such that the operative surface creates a pressure differential across the recirculation opening so that fluid is drawn from the inlet conduit into the manifold conduit.

There is also provided a modular exhaust gas recirculation assembly including a flow control body having a manifold conduit and an inlet conduit, an actuator receptacle along at least a portion of one of the manifold conduit and the inlet conduit, a closing member movably mounted in the manifold conduit between a first position and a second position, an actuator assembly contained in the actuator receptacle, and an actuator cover extending over the actuator assembly and connected to the actuator receptacle to enclose the actuator assembly. The manifold conduit includes an inner surface defining a fluid passageway. The inlet conduit is in fluid communication with the manifold conduit and extends perpendicularly from the manifold conduit. The closing member is movably mounted in the manifold conduit between a first position where the closing member lies adjacent to the inner surface the manifold conduit and blocks fluid communication between the manifold conduit and the inlet conduit, and a second position where the closing member extends into the fluid passageway of the manifold conduit and opens fluid communication between the manifold conduit and the inlet conduit such that when fluid is flowing through the manifold conduit fluid flowing in the inlet conduit is drawn into the manifold conduit. The actuator assembly is coupled to the closing member and drives the closing member between the first position and the second position.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
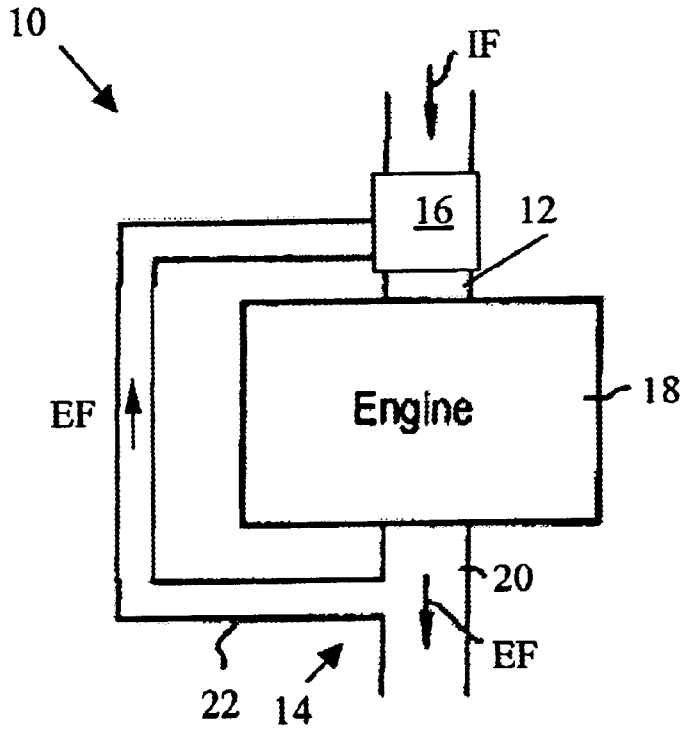
FIG. 1 is a schematic in accordance with an EGR system of an internal combustion engine according to the present invention.
Figure 2:
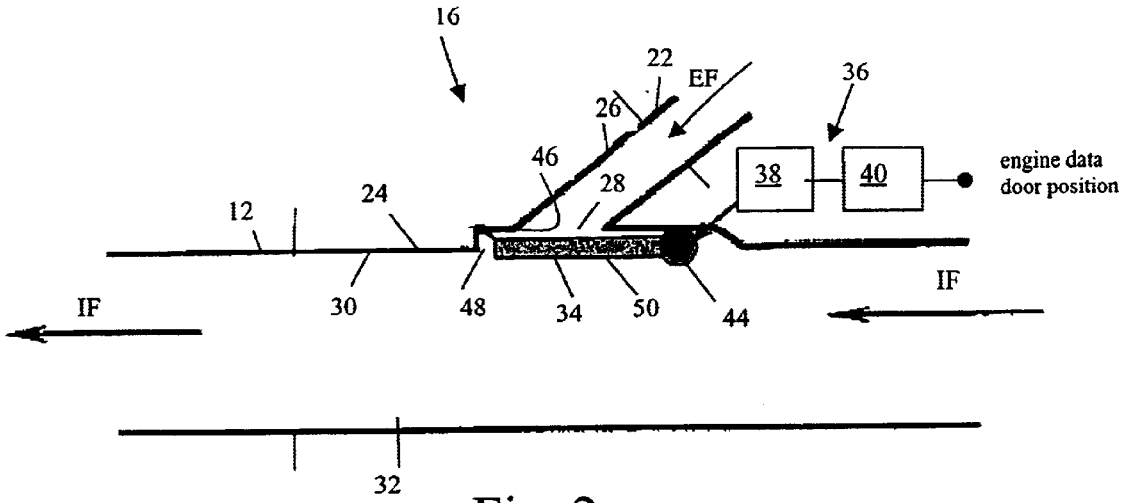
FIG. 2 is a schematic of the EGR system of FIG. 1 with the closing member in a first operating condition.
Figure 3:
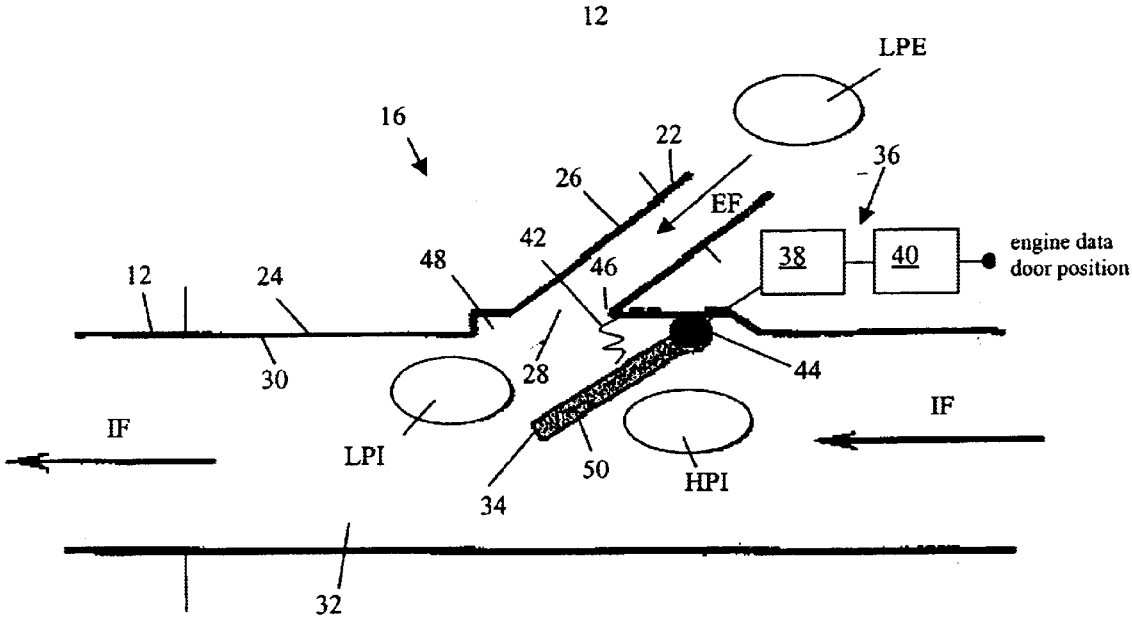
FIG. 3 is a schematic of the EGR system of FIG. 1 with the closing member in a second operating condition.

Referring to FIGS. 1–3, a first configuration of an exhaust gas recirculation (EGR) system 10 includes an intake conduit 12, an exhaust conduit 14 in fluid communication with the intake conduit 12 and a flow control body 16 between the intake conduit 12 and the exhaust conduit 14 to selectively open and close the fluid communication between the intake conduit 12 and the exhaust conduit 14. The intake conduit 12 can be a manifold in fluid communication with a plurality of combustion chambers (not shown) of an internal combustion engine 18. The exhaust conduit 14 can include an exhaust manifold 20 in fluid communication with the combustion chambers of the internal combustion engine 18 and a recirculation conduit 22 in fluid communication with the exhaust manifold 18 and the flow control body 16.

The EGR system 10 can be used with the internal combustion engine 18 to control the emissions of the engine 18 when the amount of exhaust gas flowing in the exhaust conduit 14 enters the intake conduit 12 to mix with an intake charge flowing in the intake conduit 12 on route to a combustion chamber (not shown) of the engine 18. The EGR system 10 can be used with a compression-ignition engine or a spark-ignition engine. Preferably, the EGR system 10 is used in a compression-ignition engine.

Referring to FIGS. 2 and 3, the flow control body 16 includes a manifold conduit 24 in fluid communication with the intake conduit 12 and an inlet conduit 26 in fluid communication with the manifold conduit 24 and the recirculation conduit 22 of the exhaust conduit 14. The manifold conduit 24 includes a recirculation opening 28 and an inner surface 30 defining a fluid passageway 32.

A closing member 34 is movably mounted in the manifold conduit 24. The closing member 34 performs two functions.

First, it opens and closes the recirculation opening 28 to selectively open and close the fluid communication between the intake conduit 12 and the exhaust conduit 14. Second, after the closing member 34 opens the fluid communication between the intake conduit 12 and the exhaust conduit 14, the closing member 34 meters the flow rate of exhaust gas that passes from the exhaust conduit 14 to the intake conduit 12.

An actuator assembly 36 includes a servo assembly 38 drivingly coupled to the closing member 34 and a servo controller 40 electrically connected to the servo assembly 38 and a return spring 42 biasing the closing member 34 toward the recirculation opening 28. Preferably, the servo assembly 38 includes an electric motor (not shown) drivingly coupled to a gear train (not shown). The servo controller 40 generates an actuator signal and sends it to the servo assembly 38 to move the closing member 34 from the first position to the second position. Preferably, the servo controller 40 follows a closed-loop algorithm using an engine performance data input and a door position input. Alternatively, the servo controller 40 can follow an open-loop algorithm and additional inputs can be provided to the servo controller 40, such as transmission gear selection and vehicle inclination.

Comparing FIGS. 2 and 3, the closing member 34 is movable between a first position (FIG. 2) where the closing member 34 blocks fluid communication between the intake conduit 12 and the exhaust conduit 14 and a second position (FIG. 3) where the closing member 34 opens fluid communication between the intake conduit 12 and the exhaust conduit 14 and selectively meters the flow rate of exhaust gas passing into the intake conduit 12. The exhaust gas flows through the recirculation conduit 22 in the direction indicated by arrow EF.

FIGS. 2 and 3 schematically represent the closing member 34 as a door pivoting at one end about a rotary shaft 44. Alternatively, the closing member 34 can be displaced in a different manner between the first position and the second position, such as sliding along a linear path. The servo assembly 38 can include any suitable driving mechanism that imparts the chosen pivoting motion, linear motion or other motion on the closing member, such as, an electric or pneumatic motor with or without a gear train, or a solenoid with or without a linkage.

When in the first position, as shown in FIG. 2, the closing member 34 lies adjacent the inner surface 30 of the intake conduit 12 and engages a seat 46 surrounding the recirculation opening 28 to seal the recirculation opening 28 and block the flow of exhaust gas from the recirculation conduit 22 into the intake conduit 12. Preferably, the closing member 34 is positioned in the fluid passageway 32 to minimize disturbance by the closing member 34 of the fluid flowing in the fluid passageway 32 when the closing member 34 is in the first position. As shown in FIGS. 2 and 3, this can be achieved by providing a recess 48 at a location in the inner surface 30 which surrounds the recirculation opening 28. The recess 48 receives the closing member 34 so that the closing member 34 lies approximately coplanar with the inner surface 30 when the closing member 34 is in the first position. Alternatively, a ramp can be providing on the inner surface 30 that diverts the fluid flowing in the fluid passageway 32 over the closing member 34.

When in the second position, as shown in FIG. 3, the closing member 34 is disengaged from the valve seat 46 to open the recirculation opening 28 and permit fluid communication between the recirculation conduit 22 and the intake conduit 12. In the second position, the closing member 34 extends away from recirculation conduit 22 and extends into the fluid passageway 32 to affect the fluid flowing in the intake conduit 12. By extending into the fluid passageway 32, the closing member 22 creates a high pressure region HPI in the intake passage 12 that is upstream of the recirculation opening 28 and an intake low pressure region LPI in the intake conduit 12 that is downstream of and adjacent to the recirculation opening 28. The closing member 34 can vary the pressure value of the intake low pressure region LPI by the amount to which it extends into the fluid passageway 32. As will be explained below, by varying the pressure value of the intake low pressure region LPI, the closing member 34 can meter the volume of exhaust gas entering the intake conduit 12 from the recirculation conduit 22.

During the intake cycle of the engine, the exhaust conduit 14 has a low pressure region LPE that is approximately equal to ambient atmospheric pressure. The closing member 34 further includes an operative surface 50 that causes the fluid flowing in the fluid passageway 32 to separate from a portion of the inner surface 30 adjacent the recirculation opening 28. This separation creates the intake low pressure region LPI. When the closing member 34 initially extends into the fluid passageway 32 (e.g., 10 degrees relative to a plane containing the recirculation opening), partial separation of the fluid occurs and the value of the intake low pressure region LPI is less than a maximum value. When the closing member extends far enough into the fluid passageway 32 to cause full separation (e.g., 35 degrees relative to a plane containing the recirculation opening), then the value of the intake low pressure region LPI reaches a maximum value. Thus, the extent to which of the operative surface 50 reaches into the fluid passageway 32 controls the value of the intake low pressure region LPI and, thus, the pressure differential between the exhaust low pressure region LPE and the intake low pressure region LPI during the intake cycle of the engine 18.

The geometry of the operative surface 50 is, preferably, different in shape than the boundary configuration of the fluid passageway 32 to provide an adequate value for the intake low pressure region LPI and to promote mixing of the exhaust gas from the exhaust conduit 14 with the fluid flowing in the fluid passageway 32. Preferably, the exhaust gas is mixed with the fluid flowing in the fluid passageway 32 so that each combustion chamber (not shown) of the engine receives at least some of the exhaust gas passing through the recirculation opening 28. The selected geometry must balance with the capacity of the actuator assembly 36 and the effect the operative surface 50 has on flow restriction in the intake conduit 12. The actuator assembly 36 should be of a configuration capable of generating sufficient force to move the closing member 34 between the first position and second position against the resistance created by the fluid flowing in the fluid passageway 32 against the closing member 34 while simultaneously requiring a minimum packaging volume. It is preferred that the restriction of the fluid passageway 32 by the closing member 34 minimally affect the fluid flowing through the fluid passageway 32 to the combustion chamber during the intake cycle and, thus, the power production of the engine 18.

The geometry of the operative surface 50 and the relationship between the angle of the closing member 34 and the amount of exhaust gas that enters the fluid passageway 32 are described in the U.S. patent application filed on Nov. 8, 2002, entitled "Apparatus and Method for Exhaust Gas Flow Management of an Exhaust Gas Recirculation system," U.S. application Ser. No. 10/290,497, which application is hereby incorporated by reference.

The pressure of the fluid flowing in the intake conduit 12 is approximately equal to ambient atmospheric pressure if the engine is a normally aspirated engine and is greater than ambient atmospheric pressure if the engine is a turbocharged engine. As the closing member 34 moves away from the recirculation conduit 22 and toward the second position (FIG. 3), the intake low pressure region LPI is created adjacent the recirculation opening 28 and has a value slightly less than that of the ambient atmospheric pressure. As the closing member 34 moves farther into the fluid passageway toward the second position, the value of the intake low pressure region LPI approaches vacuum pressure. The pressure differential between the intake low pressure region LPI in the intake conduit 12 and the exhaust low pressure region LPE in the recirculation conduit 22 draws exhaust gas from the exhaust conduit 14 into the intake conduit 12 through the recirculation opening 28. The amount of exhaust gas that enters the intake conduit 12 is proportional to the pressure differential between the intake low pressure region LPI and the exhaust low pressure region LPE. The pressure value of the exhaust low pressure region LPE remains relatively steady over time. Thus, a change in the flow rate of exhaust gas in the intake conduit 12 can be varied by varying the pressure value of the intake low pressure region LPI.

The extent to which of the closing member 34 reaches into the fluid passageway controls the value of the intake low pressure region LPI and, thus, the pressure differential between the intake low pressure region LPI and the exhaust low pressure region LPE during the intake cycle of the engine. When the closing member 34 first opens, the closing member 34 reaches into the fluid passageway 32 by a small amount and the intake low pressure region LPI has a value only slightly less than that of the exhaust low pressure region LPE. Accordingly, the pressure differential is small and the flow rate of exhaust gas through the recirculation opening 28 and into the intake conduit 12 is correspondingly small. The pressure value of the intake low pressure region LPI, and thus the pressure difference and flow rate of exhaust gas passing through the recirculation opening 28, increases as the closing member 34 reaches farther into the fluid passageway 32 of the manifold conduit 24. Therefore, closing member 34 opens fluid communication between the intake conduit 12 and the exhaust conduit 14 and the closing member 34 also meters the amount of exhaust gas passing into the intake conduit 12.

Figure 4:
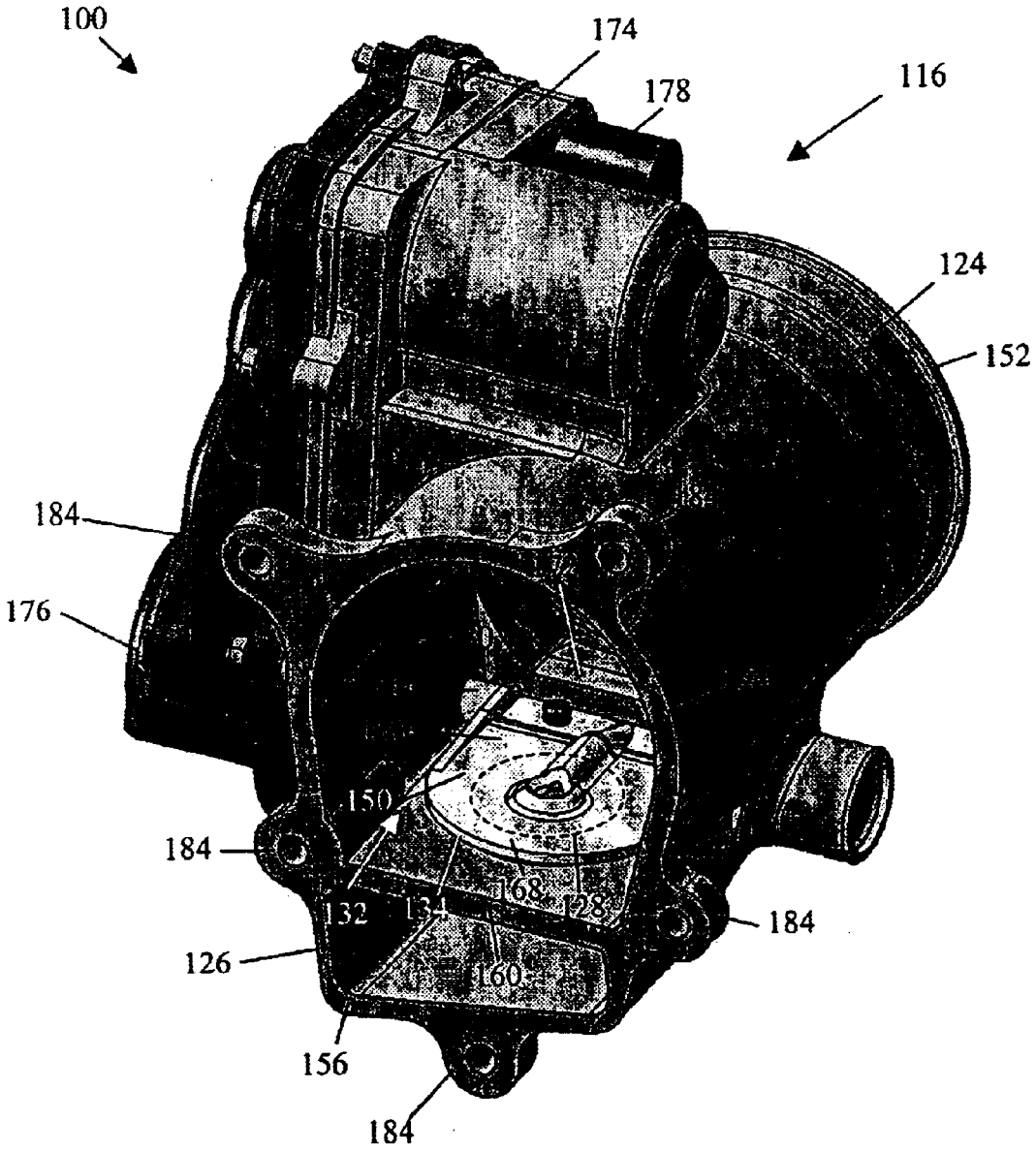
FIG. 4 is a perspective view of an embodiment of an exhaust gas recirculation assembly for an EGR according to the invention.
Figure 5:
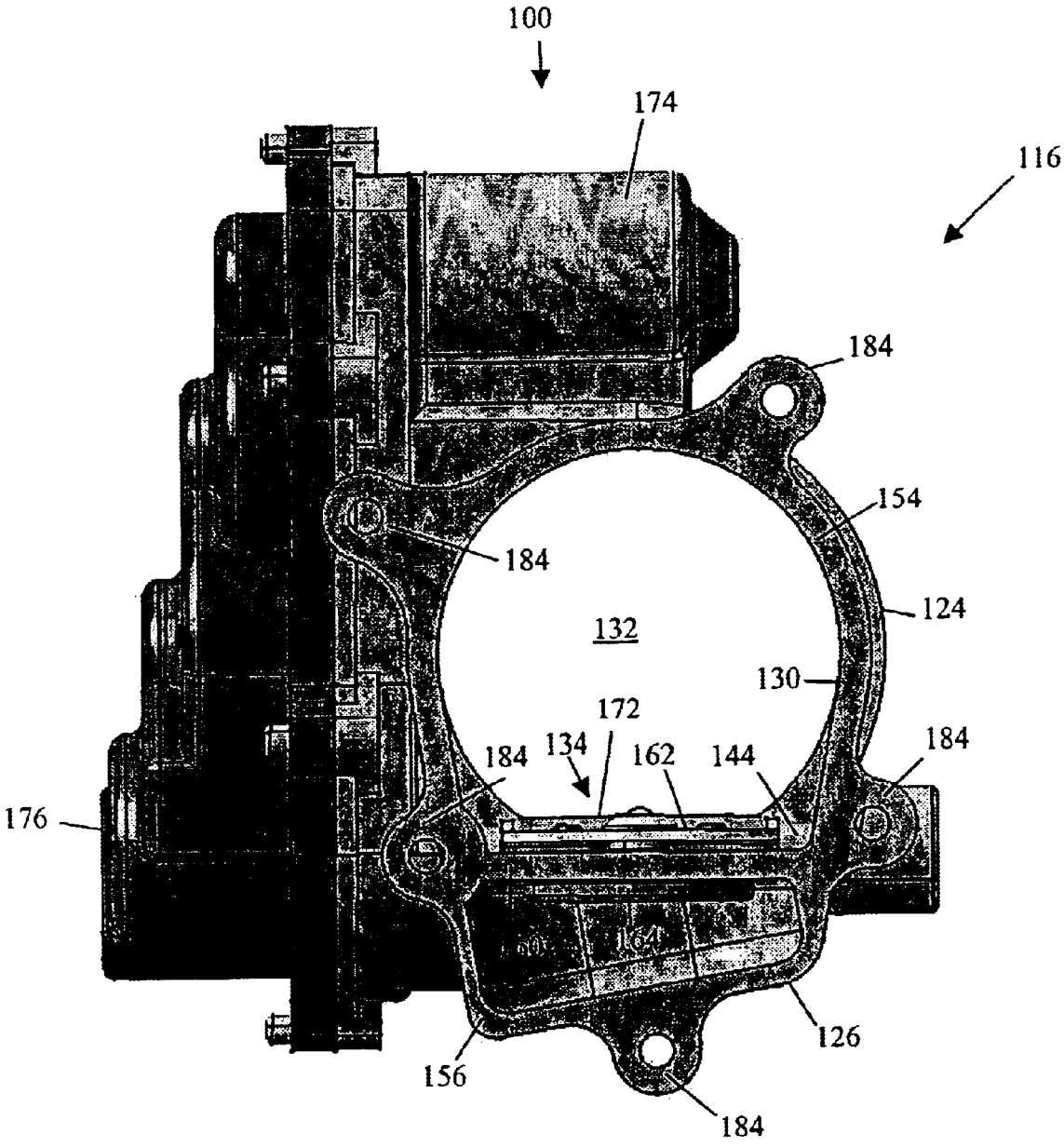
FIG. 5 is an end view of the flow control body according to FIG. 4.
Figure 6:
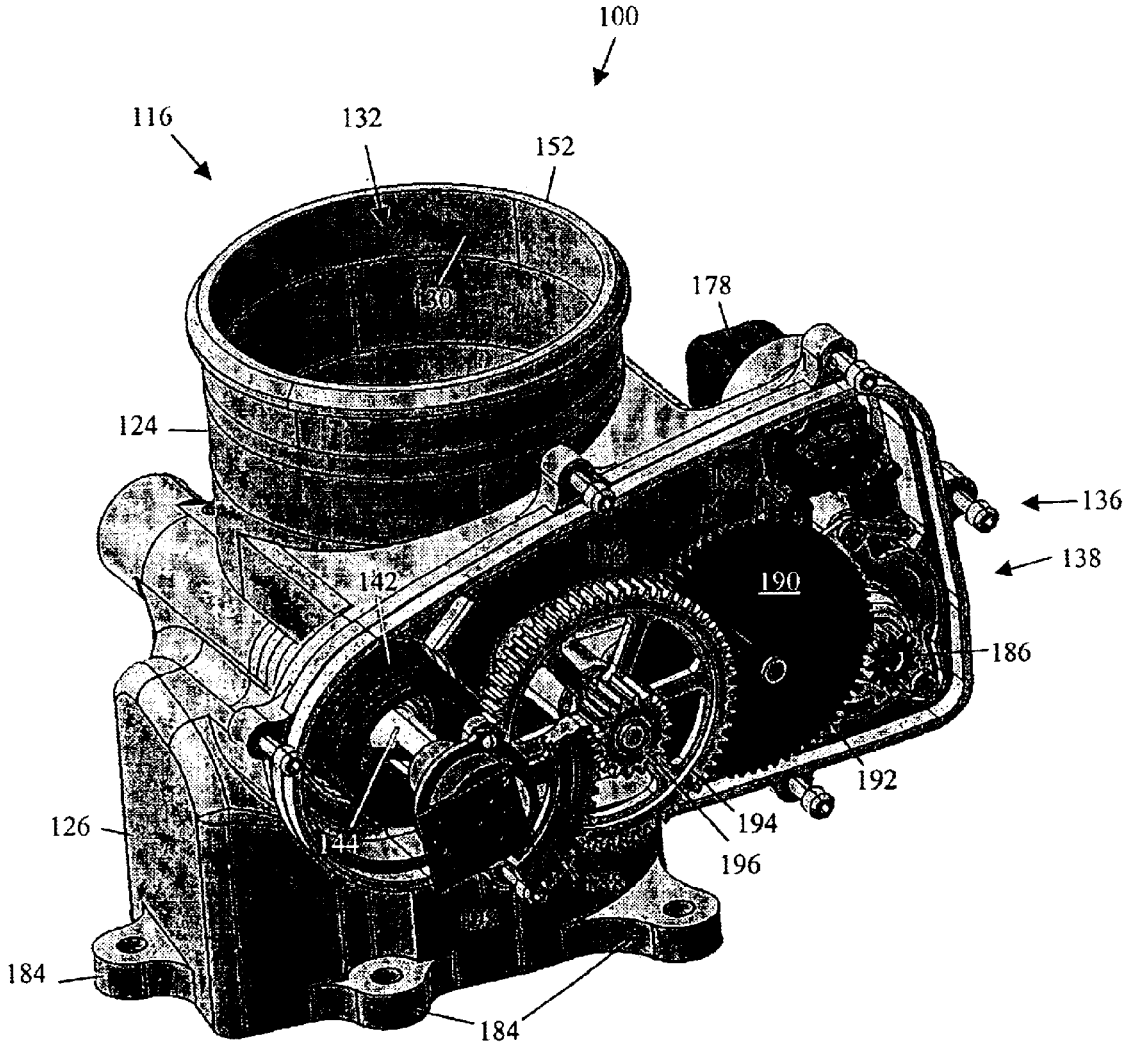
FIG. 6 is a bottom view of the flow control body according to FIG. 4.

FIGS. 4–6 illustrate an embodiment of a modular exhaust gas recirculation assembly 100 according to the EGR system 10 schematically represented in FIGS. 1–3. The modular exhaust gas recirculation assembly 100 integrates a flow control body 116, a closing member 134, and an actuator assembly 136 into a modular unit. The modular exhaust gas recirculation assembly 100 can be configured as a single component for assembly with the engine 18 (FIG. 1). This can reduce the part count for the engine 18 (FIG. 1). The modular exhaust gas recirculation assembly 100 is assembled to the engine 18 (FIG. 1) by connecting the modular exhaust gas recirculation assembly 100 to each of the intake conduit 12 and the exhaust conduit 14 (see FIG. 1) and the number of assembly steps can be minimized because the number of components for assembly is reduced.

The flow control body 116 includes a manifold conduit 124 and an inlet conduit 126 in fluid communication with the manifold conduit 124. As described above with reference to FIGS. 1–3, the manifold conduit 124 can be placed in fluid communication with an intake conduit (e.g., at 12 in FIGS. 1–3) and the inlet conduit 126 can be placed in fluid communication with a recirculation conduit of the exhaust conduit (e.g., 22 and 14 in FIGS. 1–3).

Referring to FIG. 4, the manifold conduit 124 includes a recirculation opening 128 and an inner surface 130 defining a fluid passageway 132. The recirculation opening 128 is in fluid communication with the inlet conduit 126. The inner surface 130 extends from a first open end 152 to a second open end 154. As shown in FIGS. 4 and 5, the first open end 152 and the second open 154 end each include a circular cross-sectional shape.

Referring to FIGS. 4–6, the inlet conduit 126 extends perpendicular to the manifold conduit 124 from the recirculation opening 128 to a third open end 156. The third open end 156 is adjacent to and perpendicular to the second open end 154 of the manifold conduit 124 and includes a circular cross-sectional shape.

A closing member 134 is movably mounted in the manifold conduit 124 between a first position (FIG. 6) where the closing member 134 seals the recirculation opening 128 and blocks fluid communication between the intake conduit and the exhaust conduit and a second position (FIG. 4) where the closing member 134 opens recirculation opening 128 and permits fluid communication between the intake conduit and the exhaust conduit and selectively meters the flow rate exhaust gas passing into the intake conduit.

Referring to FIGS. 4 and 6, the closing member 134 includes a flapper door 162, a seal 164 on the flapper door 162, and a rotary shaft 144 pivotally coupling the flapper door 162 to the flow control body 116. The flapper door 162 has a rectangular base 166 (in phantom in FIG. 6) and a semicircular end 168 (in phantom in FIG. 6). The rectangular base 166 of the flapper door 162 is fixed to the rotary shaft 144. Referring to FIGS. 4 and 6, a cylindrical projection 170 extends from flapper door 162 adjacent the semicircular end 168. As shown in FIG. 4, the seal 164 is mounted about the periphery of a cylindrical projection 170.

Referring to FIGS. 4 and 6, when the flapper door 162 is in the first position (FIG. 6), the cylindrical projection 170 extends through the recirculation opening 128 and the seal 164 engages the seat 146 (not shown) to block the recirculation opening 128 and close fluid communication between the intake conduit and the exhaust conduit. The flapper door 162 pivots about the rotary shaft 144 to the second position (FIG. 4) such that the flapper door 162 extends away from the recirculation opening 128 and into the fluid passageway 132.

The flapper door 162 also includes a boundary 167 (FIG. 6) that defines an operative face 150 (FIG. 4). Comparing FIGS. 4 and 6, the boundary 167 has a configuration that is different than the circular cross-sectional shape of the first open end 152 and the second open end 154. The fluid flowing in the manifold conduit 124 strikes the operative face 150 when the flapper door 162 is in the second position to create the low pressure region, as described with reference to FIG. 3.

Referring to FIG. 4, a recess 148 is located in the fluid passageway 132 of the manifold conduit 124 and surrounds the recirculation opening 128. The recess 148 is planar and is sized to accommodate the flapper door 162 when the flapper door 162 is in the first position. The planar recess 148 in the cylindrical fluid passageway 132 permits the flapper door 162 to fully engage the seat 146 of the recirculation opening 128 when the closing member is in the first position with only a minimum of disturbance to the flow flowing through the fluid passageway 132.

Other arrangements are possible to minimize disturbance by the closing member 134 of the fluid flowing through the fluid passageway 132 when the closing member 134 is in the first position, such a, providing a ramp in the inner surface 130 adjacent to the rotary shaft 144 to smoothly deflect fluid around the closing member 134.

Referring to FIGS. 4–6, the flow control body 116 also can include an actuator receptacle 174 extending from the manifold conduit 124. The actuator assembly 136 is received in the actuator receptacle 174 and is coupled to the rotary shaft 144. The actuator assembly 136 drives the rotary shaft 144 and moves the closing member 134 between the first position and the second position against the bias of the return spring 142. As shown in FIGS. 5 and 6, an actuator cover 176 extends over the actuator assembly 136 and connects to the actuator receptacle 174 to enclose the actuator assembly 136. The actuator cover 176 can include an electrical receptacle 178 electrically connected to the servo controller. The actuator cover 176 and the electrical receptacle 178 are removed from FIG. 4 to show the details of the actuator assembly 138.

Figure 7:
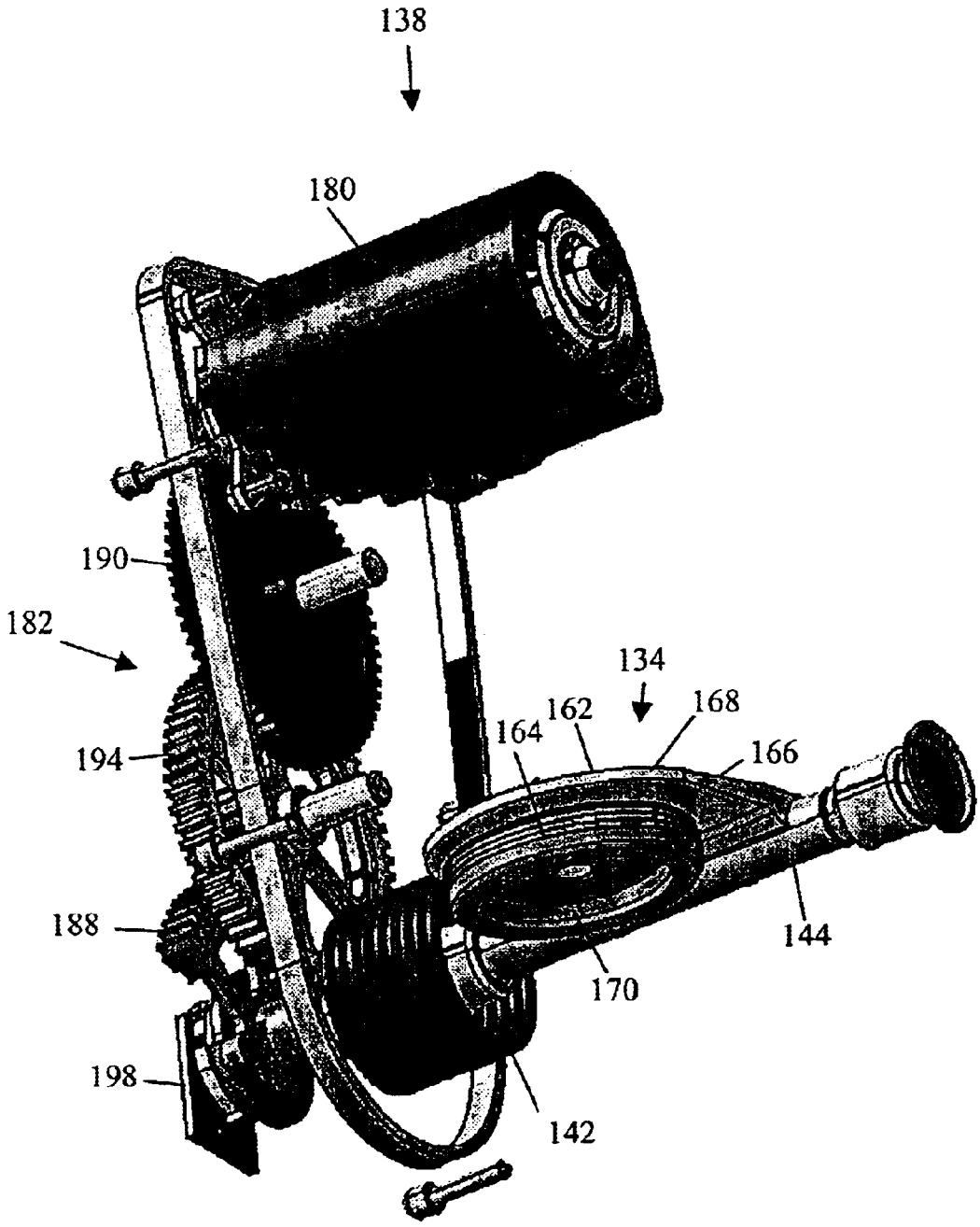
FIG. 7 is a perspective view of a torque motor for mounting in the flow control body according to FIG. 4.
Figure 8:
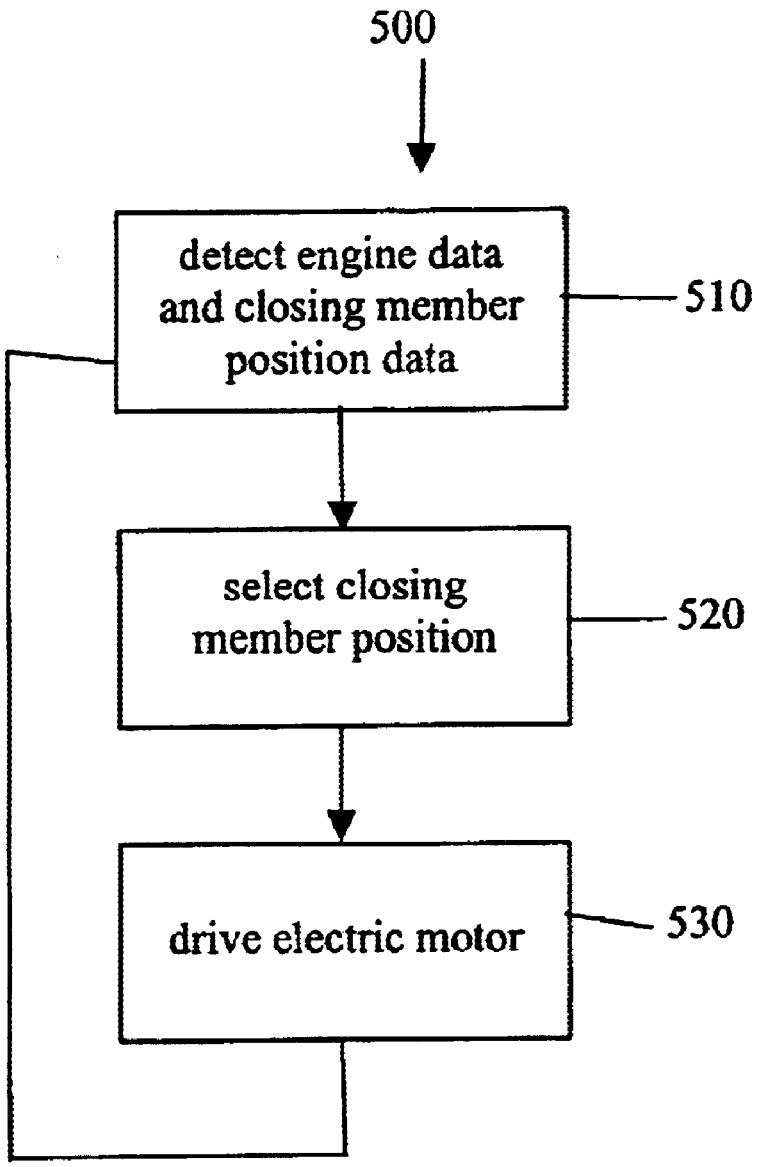

Referring to FIG. 4, the actuator assembly 136 includes a servo assembly 138 drivingly coupled to the closing member 134 and a servo controller (not shown) electrically connected to the servo assembly 138, and a return spring (not shown) connected to the closing member 134. The return spring is located inside the actuator receptacle 174 and concealed from view if FIGS. 4–6. The return spring biases the closing member 134 toward the first position. Preferably, the return spring includes a torsion spring coiled about the rotary shaft 144 with one end secured to the rotary shaft 144 and the other end secured to the flow control body 116. With reference to FIGS. 4 and 7, it is preferred that the servo assembly 138 includes an electric torque motor 180 and a shaft mount 181. The rotary shaft 144 is received in the shaft mount 182, which is driven by the electric torque motor 180. Alternatively, the servo assembly 138 can include other driving arrangements, such as, an electric torque motor with a gear train, a d.c. motor with or without a gear train, a pneumatic actuator, a hydraulic actuator, or a solenoid with or without a linkage.

The servo controller generates an actuator signal and sends it to the servo assembly 138 to move the closing member 134 from the first position to the second position. Preferably, the servo controller follows a closed-loop algorithm using an engine performance data input and a door position input. Alternatively, the servo controller can follow an open-loop algorithm and additional inputs can be provided to the servo controller, such as transmission gear selection and vehicle inclination.

As shown in FIGS. 4–6, it is preferable to include a manifold bolt flange 184 about the perimeter of the second open end 154 and an inlet bolt flange 186 about the perimeter of the third open end 156. The bolt flanges 184, 186 are adapted to receive bolts for securing the flow control body 116 to the intake conduit and the recirculation conduit. Alternatively, other arrangements can be used to secure the flow control body 116 to the intake conduit and the recirculation conduit, such as, clamps, crimped flanges, solder, and flexible conduit.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claim is:

1. A modular exhaust gas recirculation assembly comprising:

a flow control body including:

a manifold conduit including a recirculation opening, a first open end having a first cross-sectional shape and a second open end having a second cross-sectional shape; and an inlet conduit in fluid communication with the manifold conduit;

a closing member movably mounted in the manifold conduit and having a boundary defining an operative surface, the boundary having a configuration different from at least one of the first cross-sectional shape and the second cross-sectional shape, the closing member further having a first position where the closing member closes the recirculation opening and blocks fluid communication between the inlet conduit and the manifold conduit and a second position where the closing member opens the recirculation opening and permits fluid communication between the inlet conduit and the manifold conduit and such that the operative surface creates a pressure differential across the recirculation opening so that fluid is drawn from the inlet conduit into the manifold conduit; and an actuator assembly coupled to the closing member and driving the closing member between the first position and the second position.

2. The modular exhaust gas recirculation assembly according to claim 1, wherein the manifold conduit further comprises a recess surrounding the recirculation opening and the closing member is received in the recess when the closing member is the first position.

3. The modular exhaust gas recirculation assembly according to claim 2, wherein the recess extends to the second open end.

4. The modular exhaust gas recirculation assembly according to claim 2, wherein the recess comprises a planar base and the recirculation opening is located in the planar base.

5. The modular exhaust gas recirculation assembly according to claim 4, wherein the closing member includes a rectangular portion and a semicircular portion.

6. The modular exhaust gas recirculation assembly according to claim 1, wherein the actuator assembly is mounted on the flow control body.

7. The modular exhaust gas recirculation assembly according to claim 1, wherein the actuator assembly comprises:

a spring connected to the closing member and biasing the closing member toward the first position;

a servo assembly coupled to the closing member and driving the closing member toward the second position; and a servo controller electrically connected to the servo assembly and signaling the servo assembly to move the closing member between the first position and the second position.

8. The modular exhaust gas recirculation assembly according to claim 7, wherein the servo assembly comprises an electric torque motor.

9. The modular exhaust gas recirculation assembly according to claim 8, wherein the servo controller comprises a closed-loop controller including:

an engine data input; and a closing member position input.

10. The modular exhaust gas recirculation assembly according to claim 1, wherein the flow control body further comprises means for mounting the flow control body to an intake conduit and an exhaust conduit of an internal combustion engine.

11. The modular exhaust gas recirculation assembly according to claim 1, wherein the flow control body further comprises a bolt flange adjacent each of the first open end and the second open end for attachment to an intake conduit and an exhaust conduit of an internal combustion engine.

12. The modular exhaust gas recirculation assembly according to claim 1, wherein the inlet conduit comprises a pressure in a region upstream of the recirculation opening; and wherein the closing member creates a pressure in a region of the manifold conduit downstream of the recirculation opening that is less than the pressure in the inlet conduit region when the closing member is in the second position such that and the pressure differential is the difference between the pressure in the manifold conduit region and the pressure in the inlet conduit region.

13. A modular exhaust gas recirculation assembly comprising:

a flow control body including:

a manifold conduit including an inner surface definina a fluid passageway;

an inlet conduit in fluid communication with the manifold conduit and extending perpendicularly from the manifold conduit;

a recirculation opening being defined by the inner surface and in fluid communication with the manifold conduit and the inlet conduit; and an actuator recentacle along at least a portion of one of the manifold conduit and the inlet conduit;

a closing member movably mounted in the manifold conduit between a first position where the closing member lies adjacent to the inner surface of the manifold conduit and blocks fluid communication between the manifold conduit and the inlet conduit, and a second position where the closing member extends into the fluid passageway of the manifold conduit and opens fluid communication between the manifold conduit and the inlet conduit such that when fluid is flowing through the manifold conduit fluid flowing in the inlet conduit is drawn into the manifold conduit;

an actuator assembly contained in the actuator receptacle, coupled to the closing member and driving the closing member between the first position and the second position; and an actuator cover extending over the actuator assembly and connected to the actuator receptacle to enclose the actuator assembly.

14. The modular exhaust gas recirculation assembly according to claim 13, wherein the inner surface further comprises a recess surrounding the recirculation opening; and the closing member is received in the recess when the closing member is in first position.

15. The modular exhaust gas recirculation assembly according to claim 14, wherein the manifold conduit further comprises a circular cross-section and the closing member includes a cross-sectional shape different from the circular cross-sectional shape.

16. The modular exhaust gas recirculation assembly according to claim 15, further comprising a seat surrounding the recirculation opening; and the closing member includes:

a door coupled in the manifold conduit to pivot into the fluid passageway when the door moves from the first position to the second position and having:

a rectangular base;

a semicircular end extending from the rectangular base; and a projection adjacent to the semicircular end and extending into the recirculation opening when the closing member is in the first position;

a seal mounted on a periphery of the projection and engaging the seat when the door is in the first position.

17. The modular exhaust gas recirculation assembly according to claim 16, wherein the recirculation opening comprises a circular opening and the projection includes a cylindrical projection.

18. The modular exhaust gas recirculation assembly according to claim 17, wherein the actuator assembly comprises:

a spring connected to the door and biasing the door toward the first position;

a servo assembly coupled to the door and driving the door toward the second position against the bias of the spring; and a servo controller electrically connected to the servo assembly and signaling the servo assembly to move the door between the first position and the second position.

19. The modular exhaust gas recirculation assembly according to claim 18, wherein the servo controller comprises a closed-loop controller including:

an engine data input; and a door position input.

20. The modular exhaust gas recirculation assembly according to claim 19, wherein the actuator cover comprises an electrical power receptacle electrically connected to the servo controller.

21. The modular exhaust gas recirculation assembly according to claim 15, wherein the inlet conduit includes a circular cross-sectional shape.

22. The modular exhaust gas recirculation assembly according to claim 21, wherein the flow control body further comprises means for mounting the flow control body to an intake conduit and an exhaust conduit of an internal combustion engine.

23. The modular exhaust gas recirculation assembly according to claim 21, wherein the flow control body further comprises a plurality of bolt flanges adjacent the first open end and the second open end for attachment to an intake conduit and an exhaust conduit of an internal combustion engine.

* * * * *